United States Patent [19]

LeMert

[11] 4,134,324

[45] Jan. 16, 1979

[54] SOUND PROJECTOR FOR MUSICAL DRUMS

[75] Inventor: Alfred J. LeMert, Prospect Heights, Ill.

[73] Assignee: Ludwig Industries, Chicago, Ill.

[21] Appl. No.: 883,463

[22] Filed: Mar. 6, 1978

[51] Int. Cl.[2] ..... G10D 13/02

[52] U.S. Cl. ..... 84/411 R; 181/191; D17/22

[58] Field of Search ..... 84/411–420; 181/159, 191, 192; D56/1 E

[56] References Cited

U.S. PATENT DOCUMENTS

| | | | |
|---|---|---|---|
| 793,013 | 6/1905 | Miller | 181/191 X |
| 3,603,194 | 9/1971 | North | 84/411 R |
| 3,621,749 | 11/1971 | Aluisi | 84/411 R |

*Primary Examiner*—Lawrence R. Franklin
*Attorney, Agent, or Firm*—W. Melville Van Sciver

[57] ABSTRACT

A musical drum consisting of a generally cylindrical drum shell having openings at its upper and lower ends with a vibratable drum head covering at least the upper opening and a sound projector positioned below the lower opening, which sound projector is substantially a semi-hemisphere with an upper opening therein disposed adjacent the lower opening in the drum shell and with a horizontal opening therein facing in a direction substantially perpendicular to the openings in the drum shell. The half hemisphere sound projector may extend beyond the vertical center line of the shell and may be detachably secured to the shell and may be adjustable radially 360° with respect thereto.

6 Claims, 5 Drawing Figures

SOUND PROJECTOR FOR MUSICAL DRUMS

BACKGROUND OF THE INVENTION

1. Field of the Invention

The invention relates generally to a sound projector for disposition at the lower portion of a musical drum for the purpose of improving the sound qualities of a drum, such as a tom-tom, and to project the sound therefrom outwardly toward an audience and also increase the sound level produced by the drum and conveyed to an audience.

2. Description of the Prior Art

Troppe U.S. Pat. No. 2,858,724 describes a musical drum comprising a vessel or shell containing a resonant cavity which has three openings of a different size with a drum head covering each opening which may be applied to a tom-tom.

North U.S. Pat. No. 3,603,194 discloses a musical drum having a hollow elongated body which is open at both ends with a head disposed across the upper opening in the drum body and wherein the cross section of the drum body taken perpendicular to the center line is a circle having an increasing diameter starting at the narrow drum head and widening out to an open sound emitting end of the drum.

Aluisi U.S. Pat. No. 3,621,749 discloses a sound projector horn and a single head drum combination, the sound projecting horn being in the form of a flared cylindrical attachment or a mute sound projector of spherical form.

SUMMARY OF THE INVENTION

The invention relates to a sound projector for musical drums.

DESCRIPTION OF THE PREFERRED EMBODIMENT

Figure 1:
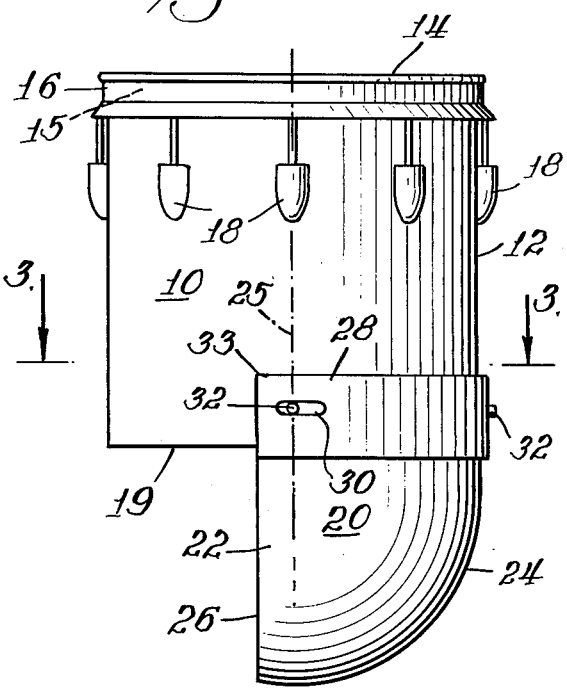
FIG. 1 is a side elevational view of a musical drum with a sound projector removably secured adjacent the bottom thereof.
Figure 2:
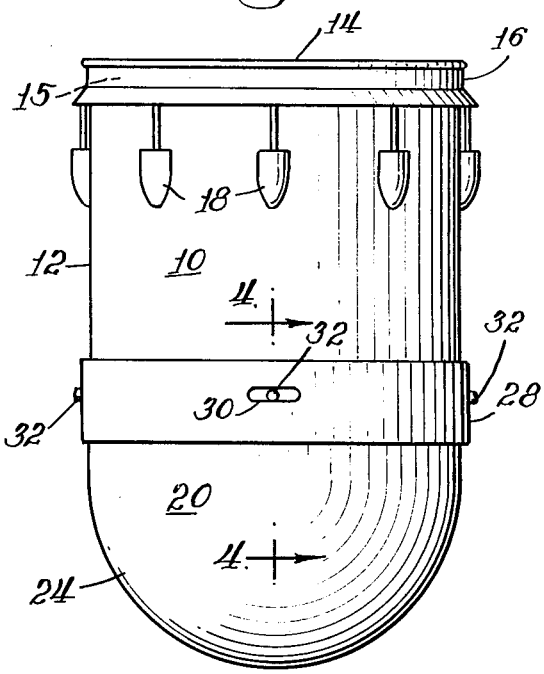
FIG. 2 is another side elevational view of the drum and sound projector.

Referring specifically to the drawing for a detailed description of the invention, numeral 10 designates generally a cylindrical shell forming a drum defining a resonant cavity 11. The present invention is particularly applicable to a drum with a single head 14, known as a tom-tom, wherein a vibratable drum head 14 is secured by a ring 16 held in position by retaining lugs 18, which head is positioned across the opening 15 at the top of the drum. An opening 19 is located at the bottom of the drum which, in drums of this type, is not provided with a head. However, a head similar to the head 14 may be used at the bottom of the drum, if desired.

Figure 3:
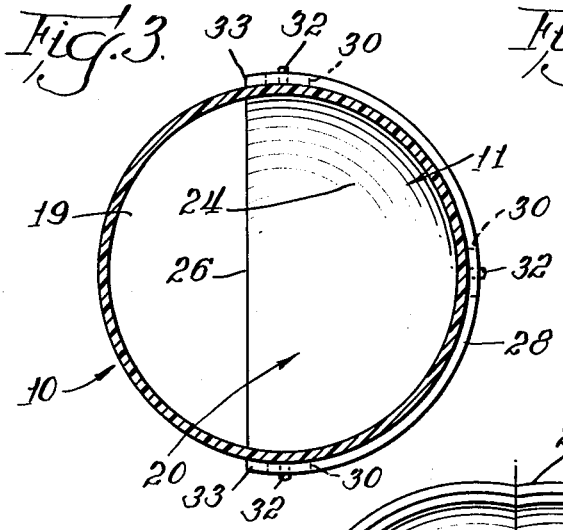
FIG. 3 is a sectional view taken on the line 3—3 of FIG. 1.
Figure 4:
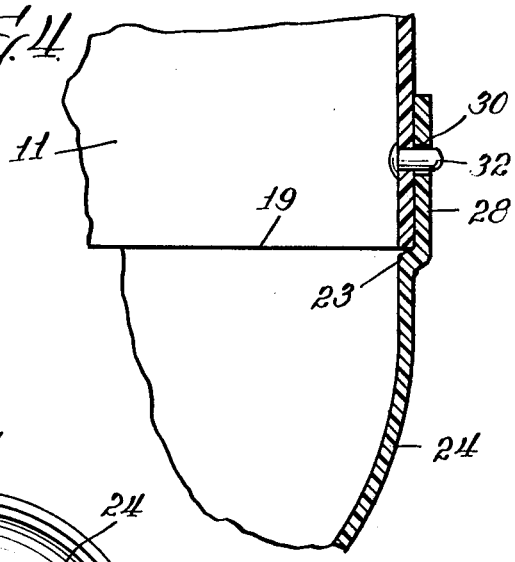
FIG. 4 is a partial sectional view taken on line 4—4 of FIG. 2.

A sound projector generally indicated by the numeral 20 is provided and comprises walls 24 in the form of a half a hemisphere which includes side walls 22 defining an opening 26 in the sound projector 20 which is in substantial alignment with an axial center line designated by the numeral 25 of the drum shell, which opening may also be described as being at substantially a 90° angle to the openings 15 and 19 in the drum shell. The sound projector 20 is also provided with an upper opening 23 and with a collar 28 preferably slightly offset outwardly from the walls 24, which collar fits snugly against the lower portion of the shell 10 externally thereof and is provided with a series of horizontal slots 30 which cooperate with studs 32 secured to the lower portion of the shell 10, which extend through the slots 30 when the projector is detachably secured to the drum shell 10. The studs 32 are arranged completely around the shell 10 to provide for 360° adjustment. As shown in FIGS. 1 and 3, the half hemisphere shape of the projector 20 preferably is not in alignment with the axial center line as shown at 33, but extends a slight distance beyond. The addition of the portion 33 improves the tone and the projecting qualities of the sound projector 20.

Figure 5:
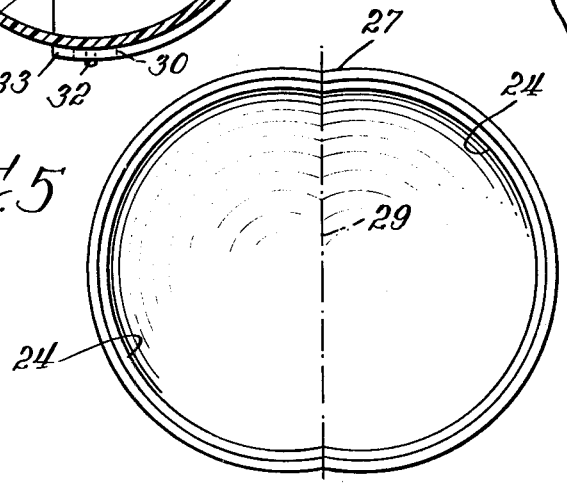
FIG. 5 is a top elevational view of the sound projector as it appears when it is removed from a suitable mold.

As shown in FIG. 5, the sound projector 20 is preferably formed in an eliptical shape with inwardly curved portions 27 adjacent the vertical center line of the eliptical shape so that two sound projectors 24 may be formed in a suitable mold and are preferably of a flexible plastic material. When the eliptical molded material shown in FIG. 5 is cut along the center line shown by numeral 29 in FIG. 5, the additional material which is provided by the curved portions 27 will expand to provide the added portions 33 to the half hemisphere of each of the sound projectors 20 thus formed. As will be apparent from the drawing, the size of the sound projector 20 is preferably approximately one-half of the vertical height of the shell 10. Also, the vertical depth of the sound projector 20 is preferably approximately equal to the horizontal radius of the shell.

The preferably plastic material of the sound projector is sufficiently flexible so that the top thereof may be expanded a sufficient distance to slide over the projections 32 so that such projections extend through the slots 30. If desired, the studs 32 and the slots 30 may not be used and, in place thereof, pads (not shown) of well-known material, such as hook and loop fastening material known by the 3M trademark "Scotch-Mate," may be secured to the bottom of the shell and to the collar 28 which also permit ready attachment of the sound projector 20 to the shell 12 and also will provide for 360° radial adjustment of the sound projector 20 with respect to the drum 10. The sound projector is, therefore, applicable to all types of drum uses.

It has been found that the sound quality, as well as the projection of the sound of the drum 10, may be considerably improved by the use of the half hemisphere sound projector 20. Furthermore, the sound projector 20 is inexpensive to manufacture and is readily attachable and detachable from the shell 12 depending upon the wishes of the drummer. In addition, complete 360° rotational directionability of sound is possible without repositioning the instrument with the result that concentrated sound in a given direction with a proportionate amount of sound redirected back-up through the head for better definition is obtained.

Further, a clearly discernible reduction of the pitch level of the instrument, at any head tension, is a direct result of mounting the subject sound projector on a drum. A definite reduction of the overtones of the head, thus producing a more pure fundamental pitch, also results and furthermore, enables the player to tension the head tighter than normal for a given pitch thereby resulting in greater ease of playing. The overall dimensioning of the hemispheric form vertically, as well as horizontally in the direction of the projection, produces, in effect, a parabolic shape in the sound projector and is an important factor in its unique alteration of the sound frequencies generated by the striking of the head.

Finally, the attachment is adaptable to any drum, the size of the drum and the sound projector being equated.

Various modifications may be made in the form of the invention without departing from the principles disclosed in the foregoing. It is my intention therefore that the accompanying claims be construed as broadly as possible consistent with the prior art.

What is claimed is:

1. A musical drum comprising a generally cylindrical shell defining a resonant cavity having an axial center line, said shell having upper and lower openings at opposite ends thereof, a vibratable drum head covering said upper opening, and a sound projecting means positioned adjacent the lower opening and comprising approximately one-half of a hemisphere of a size approximately one-half of the vertical height of said shell, said half hemisphere including curved walls with openings at approximately 90° from each other, the curved walls adjacent one opening of the half hemisphere conforming with a peripheral portion of the shell adjacent the lower opening with the other opening in said half hemisphere disposed in a plane substantially parallel with the axial center line of said shell.

2. A musical drum as set forth in claim 1 wherein the vertical depth of said sound projecting means is approximately equal to the horizontal radius of said shell.

3. A musical drum as set forth in claim 1 wherein the edges of the half hemisphere defining the last mentioned opening therein are offset a distance past said axial center line of the shell.

4. A musical drum as set forth in claim 1 wherein said sound projecting means includes a collar at the top thereof and means on said collar and said shell cooperating to secure the two together.

5. A musical drum as claimed in claim 1 including means for detachably securing the sound projecting means to said shell.

6. A musical drum as claimed in claim 1 including means for radially adjusting the sound projecting means relative to said shell.

* * * * *